US005398752A

United States Patent [19]

Abbott

[11] Patent Number: 5,398,752

[45] Date of Patent: Mar. 21, 1995

[54] STRIP FIN AND TUBE HEAT EXCHANGER

[76] Inventor: Roy W. Abbott, 450 N. Hubbards La., Louisville, Ky. 40207

[21] Appl. No.: 108,307

[22] Filed: Aug. 19, 1993

[51] Int. Cl.[6] ..... F28F 1/32
[52] U.S. Cl. ..... 165/171; 165/183
[58] Field of Search ..... 165/171, 183

[56] References Cited

U.S. PATENT DOCUMENTS

| | | |
|---|---|---|
| 1,970,105 | 8/1934 | Smith . |
| 2,268,885 | 1/1942 | McCullough . |
| 2,366,224 | 1/1945 | Warp . |
| 2,492,909 | 12/1949 | Warp . |
| 2,596,997 | 5/1952 | Harter . |
| 2,676,001 | 4/1954 | Polard . |
| 2,703,702 | 3/1955 | Meinel . |
| 2,705,877 | 4/1955 | King . |
| 2,722,732 | 11/1955 | Sandberg . |
| 2,930,208 | 3/1960 | Lyman . |
| 3,224,503 | 12/1965 | Konanz . |
| 3,379,241 | 4/1968 | Gau . |
| 3,380,518 | 4/1968 | Cauteloube et al. . |
| 3,460,613 | 8/1969 | Kritzer . |
| 3,779,311 | 12/1973 | O'Connor et al. . |

FOREIGN PATENT DOCUMENTS

| | | | |
|---|---|---|---|
| 121089 | 5/1966 | Czechoslovakia | 165/171 |
| 2668250 | 4/1992 | France | 165/171 |
| 2921908 | 12/1980 | Germany | 165/171 |
| 976003 | 11/1964 | United Kingdom | 165/171 |
| 1006039 | of 1965 | United Kingdom | 165/171 |

*Primary Examiner*—Allen J. Flanigan

[57] ABSTRACT

A strip fin sheet and tube heat exchanger formed by lancing a series of parallel rows of strip fin separated by a series of interconnecting unlanced strips which are connected in a heat transferring relationship to an outer surface of a tubular member for feeding a working fluid therethrough.

The heat exchanger is generally of a plane form with the length of lanced fin strips being parallel to the plane while the width of lanced fin strips are twisted to an acute angle generally perpendicular to the plane of the sheets forming the assembly, thus forming a path for desired air to be forced to flow therethrough in a direction perpendicular to the plane of the sheets and parallel to the strip width or depth.

The heat exchanger is intended for use in a forced draft application such as used in an air conditioner or refrigerator evaporator or condenser.

19 Claims, 4 Drawing Sheets

HEAT EXCHANGER 10

STRIP FIN AND TUBE HEAT EXCHANGER

BACKGROUND OF THE INVENTIONS

The present invention relates to tube and fin heat exchangers, such as condensers in refrigerator or air conditioning units.

In producing a heat transfer surface, it is economically advantageous to attempt to provide the exposed surface area in contact with two fluids in an inverse ratio of the fluid s ability to transfer heat. For example, in a refrigerant to air exchanger, refrigerant has a significantly greater ability to transfer heat to the inside of its tubular container than does air to the outside of the tubing. For this reason, it is accepted practice to add surface area to the air side of the device in the form of fins. The present invention employs a unique fabricating process to improve fin material utilization and increase the heat transfer coefficient by miniaturizing fins into small strips.

It is well known by those skilled in heat transfer that the air side heat transfer coefficient is enhanced almost asymptotically with the inverse of fin perimeter, particularly when the fins members are arranged in a position perpendicular to the direction of air flow. This maximizes the flow of heat between fin and air by minimizing the boundary layer of stagnant air at the fin surface.

In simplistic form the equation for transfer of heat is $Q=Ah\Delta T$, where Q is the heat transfered in BTU/hr, A is the surface area, h is the film heat transfer coefficient, and $\Delta T$ is the difference in temperature. The heat transfer coefficient h between the refrigerant and the tube is very high (about 200 to 300 BTU/hr/Deg F.), while the h for air is quite low (from 8 to 30 BTU/hr-/Deg/F.). From a practical standpoint it is never possible to apply sufficient external surface area to overcome this difference in heat transfer coefficient for the two fluids. However, the value of air side heat transfer coefficient can be enhanced significantly by producing the fins in the form of strips with minimum distance from the leading edge to the leaving edge. Thus, increasing the heat transfer coefficient and reducing fin width minimizes boundary layer depth, providing increased air side heat transfer.

DESCRIPTION

In order to provide a low cost, highly efficient heat exchanger, this invention combines sheets of lanced fin stock with tubing formed into a serpentine shape. Both lanced sheet and tubing are existing materials but combining the two into a heat exchanger is considered novel. Extending the forming of the lanced sheet to produce multi-layered strip fin material for greater depth and increased heat transfer capacity is also considered novel.

The heat exchanger is generally of a plane form with the length of lanced strips being parallel to the plane while the width of lanced fin strips are twisted to an acute angle generally perpendicular to the plane of the sheets forming the assembly, thus forming a path for desired air to be forced to flow therethrough in a direction perpendicular to the plane of the sheets and parallel to the strip width or depth.

The heat exchanger assembly is intended for use in a forced draft application such as used in an air conditioner or refrigerator evaporator or condenser.

Several prior art references teach the design and manufacture of louvered sheet such as used in window "shade screen" product produced under U.S. Pat. Nos. 2,366,224 and 2,492,909 by WARP. However, none teach the grooving of louvered sheet for multi-layered application as does the present invention.

Several prior art references teach various designs to improve the heat transfer of tube and fin heat exchangers. Prior art reference U.S. Pat. No. 3,379,241 shows a refrigerant tube attached to a rear grill in an attempt to utilize said grill for product protection/appearance and salvaging as much heat dissipation as possible. This structure is very ineffective in use of material since the grill must be of a relatively thick cross section to provide structural rigidity to the relatively long louvers. U.S. Pat. No. 2,676,001 teaches a refrigerant tube attached to expanded metal in one case and sandwiched between two sheets of expanded metal in another. Expanded metal is a poor choice for a fin since the ratio of material to exposed surface is quite poor. Moreover, the patent teaches edges of expanded metal have a higher heat transfer efficiency than the sides of the metal. However, this is true only because the air flow is past edges oriented parallel to the slit edge. Furthermore, U.S. Pat. No. 2,930,208 teaches yet another expanded metal heat exchanger with refrigerant tubes sandwiched between two sheets and used primarily as a combination appearance grill and heat exchanger. All expanded metal heat exchangers have the same disadvantage: poor ratio of exposed surface area to material ratio. None of the above mentioned references teach the novel method of strip fin louvered sheet and tube heat exchanger to improve the heat transfer to surface area ratio as does the present claimed invention.

It is an object of the present invention to provide a low cost method of producing a louvered strip fin sheet.

It is another object of the present invention to provide miniature strip fins of minimum depth for maximum air side heat transfer coefficient.

It is another object of the present invention to provide the option of utilizing multiple formed louvered sheets to match coil depth to higher heat transfer requirements.

It is another object of the present invention to bond the strip fin louvered sheet with the refrigerant tubular conduit to form a coil assembly with good thermal conductivity between these two members.

It is another object of the present invention that its application requires that air be moved across the heat exchanger assembly by a forced draft air moving system.

Lastly, it is an object of the present invention to provide a heat exchanger with all strip fins oriented generally parallel to the direction of the air flow.

BRIEF DESCRIPTION OF THE DRAWINGS

A better understanding of the present invention will be had upon reference to the following description in conjunction with the accompanying drawings in which like numbers refer to like parts throughout the several views within:

As shown in FIG. 1, a roll of sheet stock 11 is pulled through a pair of rotary stock cutters 26 having cutting teeth which lance parallel rows of strip fins 16 separated by narrow unlanced strips 18 and edges 19 in the sheet 11. An alternate process is shown in FIG. 2. A combination punch and die assembly 27 forms strip fins 16 in the sheet 11. In FIG. 1 and 2, a combination punch and die 27 or multiple lance cutting rolls 26 form lanced sheets 17 as best shown in section view of FIG. 3. A preformed tube assembly 30, illustrated in FIG. 4, can be seam welded, overlapping spot welded, laser welded, copper brazed, soldered or adhesive bonded to steel and alloys thereof sheets; or laser seam welded, oven brazed, dip brazed, vacuum brazed, or adhesive bonded to aluminum, copper and alloys thereof sheets to form the tube and fin heat exchanger 10 as shown in FIG. 5, 7, & 12.

As illustrated in FIG. 6, a two sheet tube and fin heat exchanger is formed by joining lanced sheets 17 to preformed tubing 30 resulting in a double layer of strip fin sheet material due to overlapping of the unlanced strip 18 of sheet 17 over the tubing 30 at the joint 31.

Heat exchangers made in this concept allows independent selection of tube wall thickness and fin thickness. The tube wall thickness can be selected to meet any desired pressure containment specifications while the fin thickness can be selected independently based on optimization of heat transfer, rigidity and economics considerations.

An alternate method of providing a louvered sheet and tube heat exchanger with two times the air side surface area can be produced by laminating four sheets of fin material 17 shown in FIG. 8, 9, 10, & 11.

Figure 1:
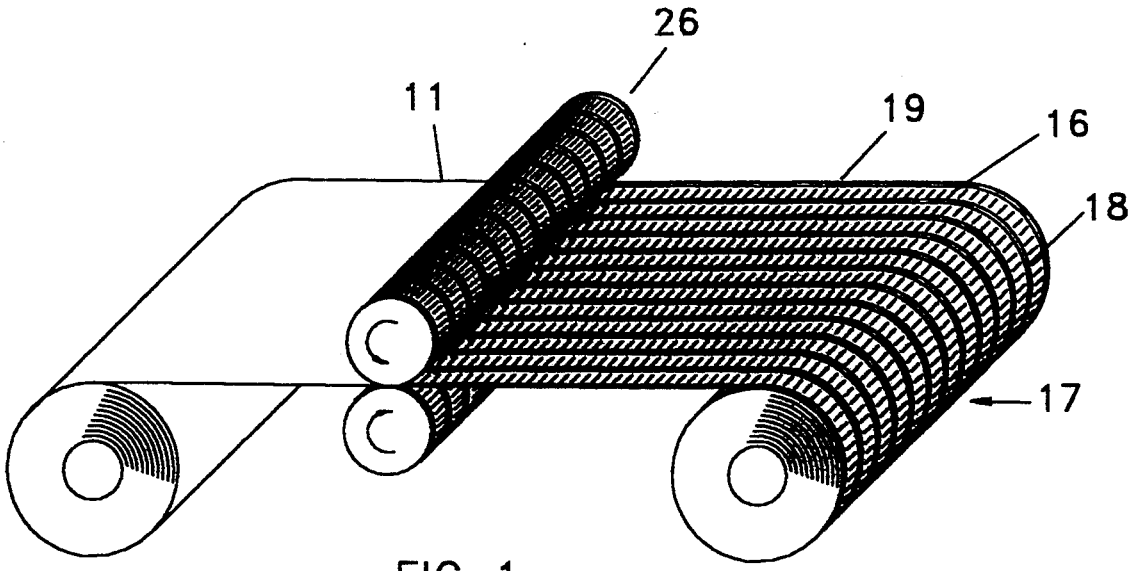
FIG. 1 is a perspective view showing a means of lancing sheet material into parallel rows of strip fin by means of rotary cutters and recoiling same for later use.
Figure 2:
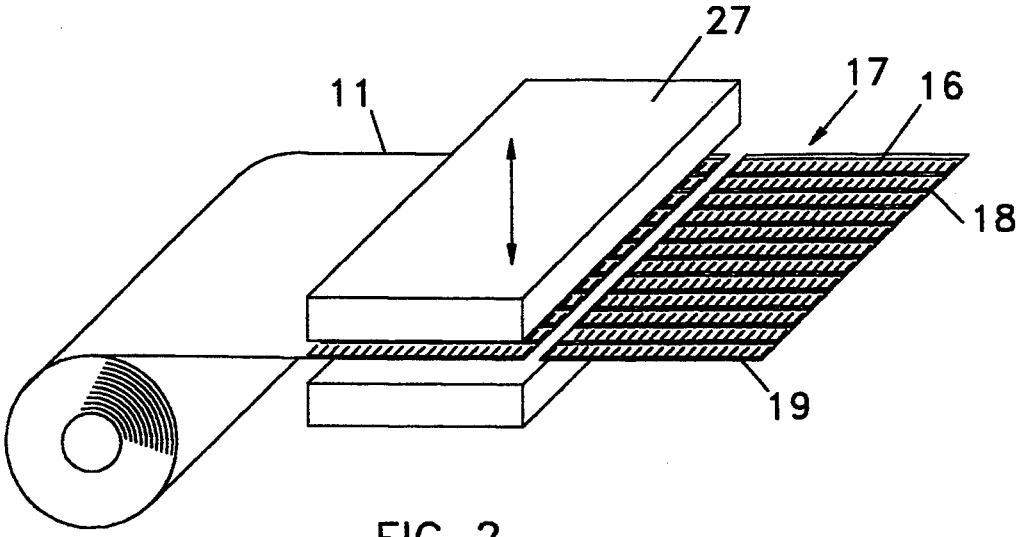
FIG. 2 is a perspective view showing an alternate means of lancing the sheet and shearing to desired length by means of a punch and die set.
Figure 3:
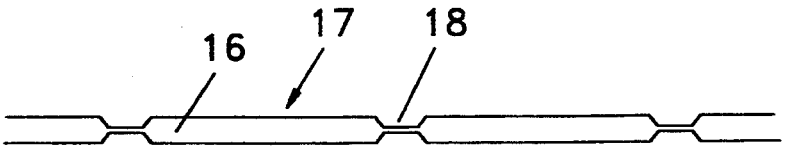
FIG. 3 shows a partial end view of the lanced fin strip.
Figure 4:
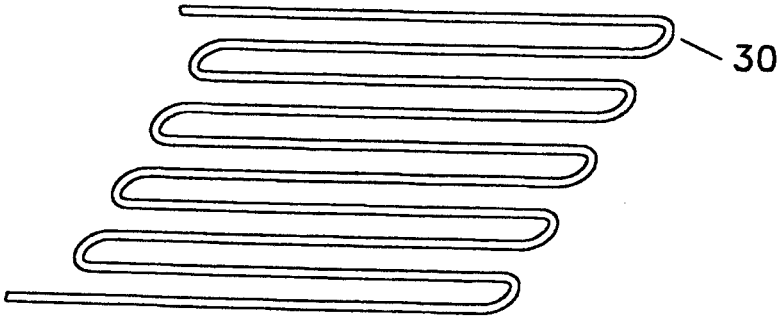
FIG. 4 is a perspective view of a serpentined refrigerant tube assembly.
Figure 5:
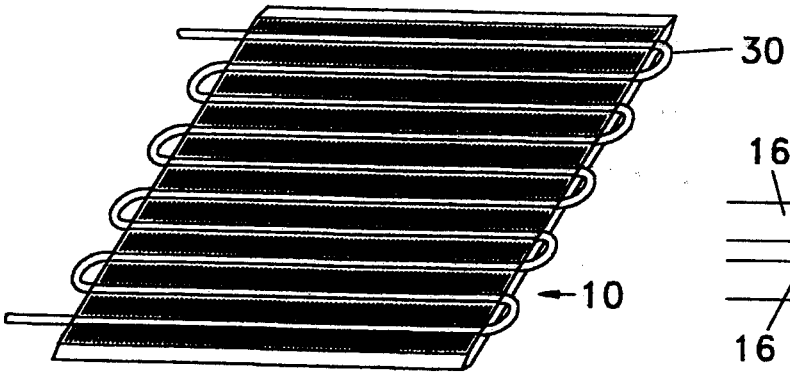
FIG. 5 is a perspective view of the integral tube and fin heat exchanger after assembly.
Figure 6:
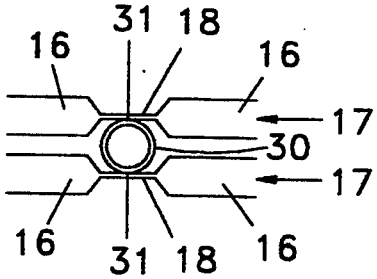
FIG. 6 is an end view of a tube and fin heat exchanger formed by joining unlanced interconnecting strips of the lanced sheets to preformed tubing resulting in overlapping of the sheet over the tubing at the joint.
Figure 7:
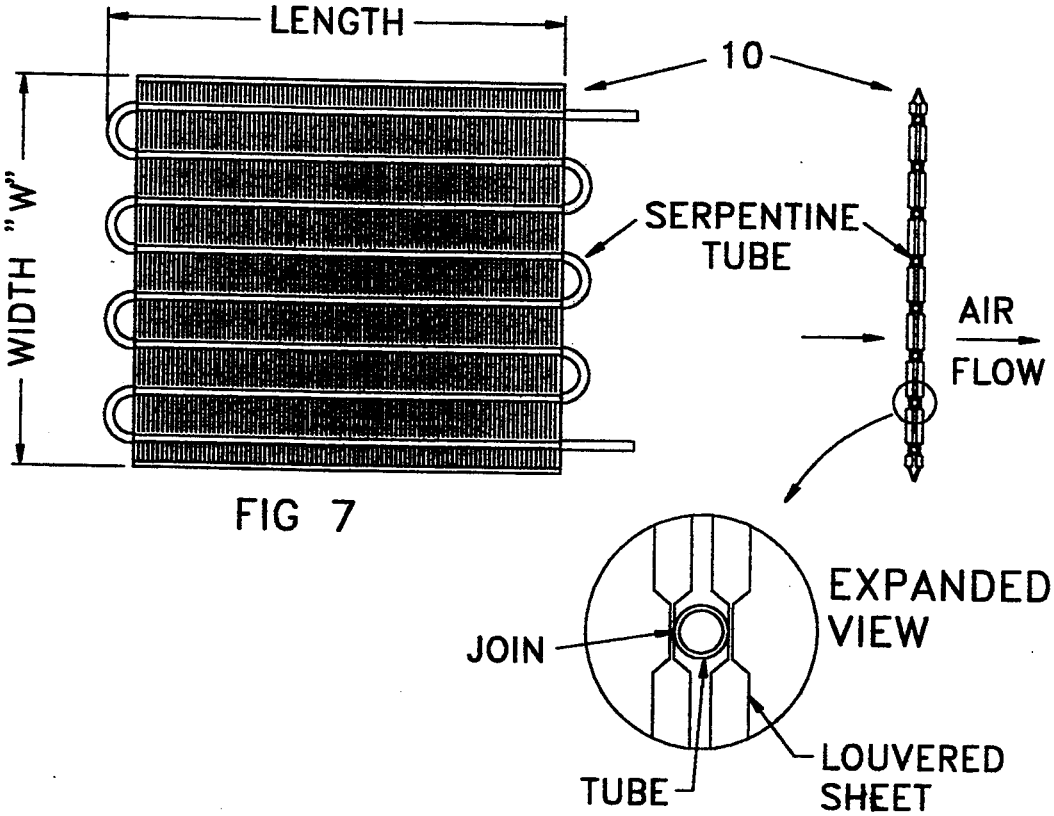
FIG. 7 is a completed heat exchanger with plan view of desired width and length and an end view of serpentined tubing sandwiched between lanced sheets and an expanded view of the joint between the tube and the unlanced strip between each row of lanced strip fins.
Figure 8:
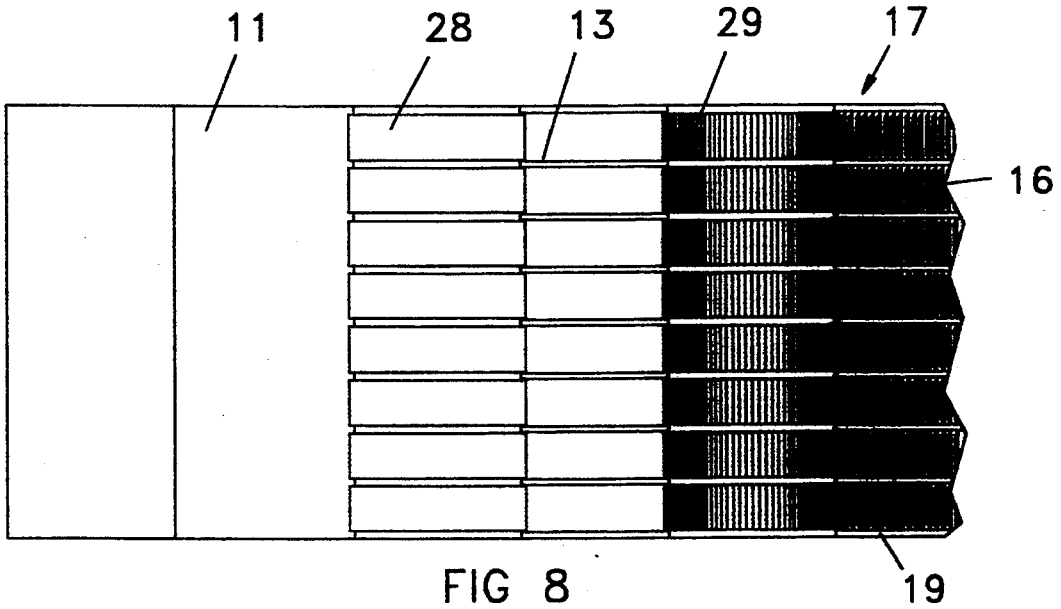
FIG. 8 is a plan view showing a means of grooving and lancing the fin sheet in preparation for four strip exchanger assembly.
Figure 9:
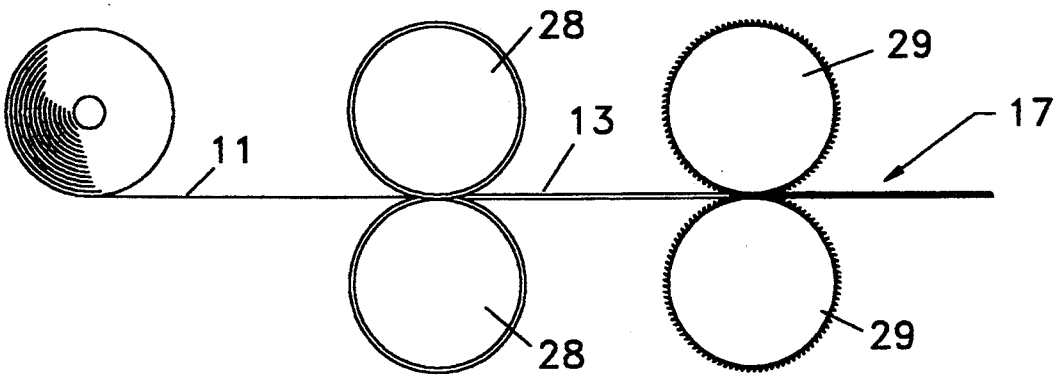
FIG. 9 is a side view of FIG. 8 showing the relationship of the grooving and lance cutter rolls.
Figure 10:
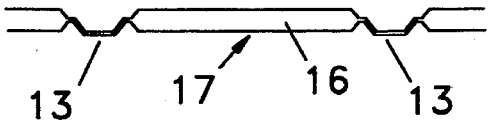
FIG. 10 is an enlarged end view of a grooved and lanced sheet, with the louver forming the fin circuit.
Figure 11:
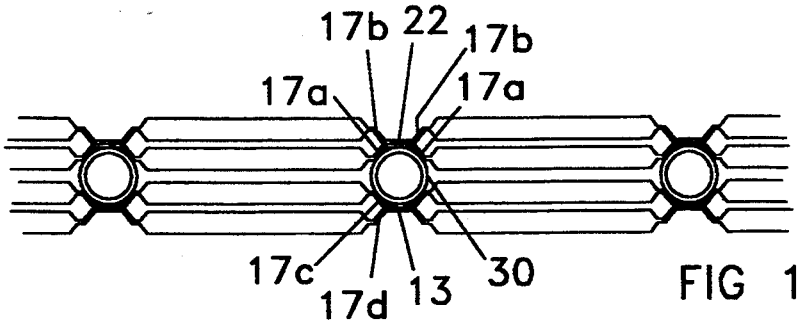
FIG. 11 is an end view of a tube and fin exchanger formed by joining four grooved and lanced sheets to preformed tubing resulting in overlapping of the sheets over the tubing at the joint.
Figure 12:
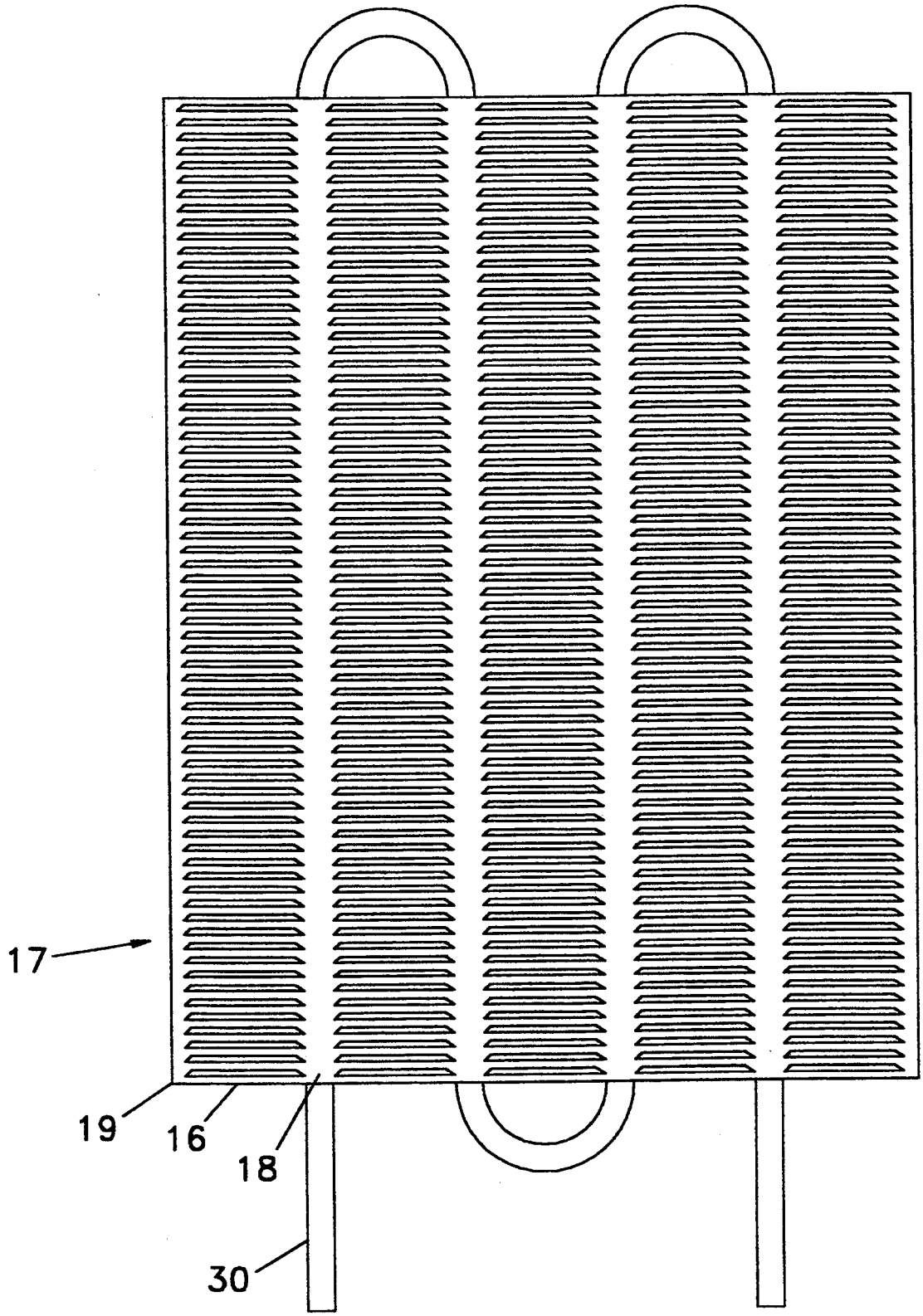
FIG. 12 shows a photo copy of a small heat exchanger as previously described in FIG. 7 and illustrates how the unlanced outer edge 19 form the outer edge of the heat exchanger, the heat transfer relationship between tube 30 and unlanced strip 18, as well as the disposition of strip fins 16.

As shown in FIG. 8 and 9, a roll of sheet stock 11 is pulled through a pair of form rolls 28 to produce a series of parallel grooves 13. The sheet stock continues between a group of equally spaced rotary lance cutters 29 to form rows of strip fins 16. A sectional view of one strip fin and two grooved rows is shown in FIG. 10. The lanced and grooved material is sheared to the desired length and assembled to preformed serpentine tube 30 in such a manner as to invert alternate sheets 17 as shown in FIG. 11. Sheet 17*a* is oriented with female groove next to tube 30; sheet 17*b* is inverted to match male side of groove 17*a*. Likewise, sheet 17*c* has female side of groove nested to tube 30 while sheet 17*d* has male side of groove in alignment with male side of 17*c*. The four strip fin laminates are joined to themselves and tube 30 at joint 22 to form a complete heat transfer surface assembly.

I claim:

1. A strip fin sheet and tube heat exchanger assembly comprising of at least two thermally conductive sheets of material lanced in a series of parallel rows of strip fins separated by interconnecting unlanced strips. A tubular refrigerant conduit is disposed between said sheets and said unlanced portions of said thermally conductive sheets are connected in a heat transfer relationship to the opposite outer surfaces of said tubular conduit to provide a heat transfer path between said refrigerant conduit and said interconnecting strips; and said lanced sheets forming an air conduit having a plurality of strip fins with slits therebetween for a flow of air to be forced therethrough.

2. The invention of claim 1 wherein said refrigerant tube is serpentine and the bends of said serpentine are presented beyond the proximal and distal ends of said sheets.

3. The invention of claim 1 wherein the number of thermally conductive sheets is four and said unlanced portion of said sheets is formed into a groove to promote heat transfer contact with said tube and provide separation of said lanced strips when said lanced strips are placed in heat transfer relationship with said tube.

4. The invention of claim 1 wherein said lanced strip fins are oriented generally perpendicular to the plane of strip fin sheets forming a path for air flow through said assembly.

5. The invention of claim 3 wherein said lanced strip fins are oriented generally perpendicular to the plane of said strip fin sheets forming a path for air flow through said assembly.

6. A strip fin sheet and tube heat exchanger assembly of claim 1, wherein the unlanced outer edges of said lanced strip fin sheets are connected together to form an unlanced boundary of said assembly.

7. A strip fin sheet and tube heat exchanger assembly of claim 3, wherein the unlanced outer edges of said lanced strip fin sheets are connected together to form an unlanced boundary of said assembly.

8. A strip fin sheet and sandwiched tube heat exchanger of claim 1, wherein said thermally conductive sheet and tubular material is selected from a group of metallic materials consisting of aluminum, steel, copper, brass, nickel, and alloys thereof.

9. A strip fin sheet and sandwiched tube heat exchanger of claim 2, wherein said thermally conductive sheet and tubular material is selected from a group of metallic materials consisting of aluminum, steel, copper, brass, nickel, and alloys thereof.

10. A strip fin sheet and sandwiched tube heat exchanger of claim 1, wherein said thermally conductive strip fin sheet has a thickness in the range of about 0.003 to 0.015 inches in thickness.

11. A strip fin sheet and sandwiched tube heat exchanger of claim 2, wherein said thermally conductive strip fin sheet has a thickness in the range of about 0.003 to 0.015 inches in thickness.

12. A strip fin sheet and sandwiched tube heat exchanger of claim 1, wherein said tubular refrigerant conduit shall consist of a sufficient wall thickness to contain a range of from about 300 to about 700 pounds pressure per square inch, as required.

13. A strip fin sheet and sandwiched tube heat exchanger of claim 2, wherein said tubular refrigerant conduit shall consist of a sufficient wall thickness to contain a range of from about 300 to about 700 pounds pressure per square inch, as required.

14. A strip fin sheet and sandwiched tube heat exchanger of claim 1, wherein each fin strip contains from about six to about thirty-three strip fins per inch forming strip fins having a width or depth of from about 0.167 to about 0.030 inches in width or depth in each fin strip.

15. A strip fin sheet and sandwiched tube heat exchanger of claim 2, wherein each fin strip contains from about six to about thirty-three strip fins per inch forming strip fins having a width or depth of from about 0.167 to about 0.030 inches in width or depth in each fin strip.

16. A strip fin sheet and sandwiched tube heat exchanger of claim 1, wherein said strip fins are twisted at an angle ranging from about zero to forty-five degrees from the vertical axis normal to the surface of the fin strip.

17. A strip fin sheet and sandwiched tube heat exchanger of claim 2, wherein said strip fins are twisted at an angle ranging from about zero to forty-five degrees from the vertical axis normal to the surface of the fin strip.

18. A strip fin sheet and sandwiched tube heat exchanger of claim 1, wherein the length of said strip fin is selected to provide a fin effectiveness of not less than 80 percent.

19. A strip fin sheet and sandwiched tube heat exchanger of claim 2, wherein the length of said strip fin is selected to provide a fin effectiveness of not less than 80 percent.

* * * * *